United States Patent [19]

Marr et al.

[11] Patent Number: 5,001,301

[45] **Date of Patent: * Mar. 19, 1991**

[54] TWIST-ON WIRE CONNECTOR WITH EXPANSION SPRING

[75] Inventors: Donald W. Marr, Oakville; Robert M. McLaughlin, Sutton, both of Canada

[73] Assignee: Marr Electric Limited, Mississauga, Canada

[ * ] Notice: The portion of the term of this patent subsequent to May 8, 2007 has been disclaimed.

[21] Appl. No.: 360,546

[22] Filed: Jun. 2, 1989

[51] Int. Cl.[5] ..... H01R 5/12

[52] U.S. Cl. ..... 174/87

[58] Field of Search ..... 174/87; 403/214, 265, 403/268, 270

[56] References Cited

U.S. PATENT DOCUMENTS

| | | | |
|---|---|---|---|
| 3,097,257 | 7/1963 | Cheney | 174/87 |
| 3,156,761 | 11/1964 | Schinske | 174/87 |
| 3,448,223 | 6/1969 | Thorsman | 174/87 |
| 3,676,574 | 7/1972 | Johansson et al. | 174/87 |
| 3,875,324 | 4/1975 | Waddington et al. | 174/87 |
| 4,112,251 | 9/1978 | Scott | 174/87 |
| 4,227,040 | 10/1980 | Scott | 174/87 |
| 4,288,657 | 9/1981 | Swanson | 174/87 |

*Primary Examiner*—Morris H. Nimmo

*Attorney, Agent, or Firm*—Donald E. Hewson

[57] ABSTRACT

The invention concerns twist on wire connectors for electrically connecting ends of wires. A cap is provided in combination with an expansion spring for gripping the wires, the cap having thin walls and external ribs providing the walls with rigidity and a gripping surface. Within the cap is a hollowed out region to allow the spring space to expand. Preferably the spring is of slightly concave shape in an axial direction i.e. it is waisted. The new connector caps permit the economic use of expansion springs and permit a greater range of wire sizes and number of wires to be gripped by a connector.

4 Claims, 1 Drawing Sheet

TWIST-ON WIRE CONNECTOR WITH EXPANSION SPRING

FIELD OF THE INVENTION

This invention relates to twist on wire connectors and the insulating caps that form the outer shell of the connector. More particularly, this invention relates to insulating caps having a relatively thin circumferential wall, and having a configuration that is adapted to resist considerable forces—including especially bursting forces in a radial direction.

BACKGROUND OF THE INVENTION

It is common in the electrical wiring industry—such as domestic or industrial wiring and the like—to connect a plurality of wires in electrically conductive relation by using a twist on wire connector. Typically, twist on wire connectors comprise a plastic insulating cap and a coil of wire contained therein. The cap acts as a insulating housing around the coil and also provides a means for gripping the connector in order to twist it onto the wires. The coil comes into contact with the plurality of wires being connected. The gripping forces necessary to retain the wires in electrically conductive relation inside the coil are provided by both the coil and the cap. If the forces are provided by the cap, they are transmitted to the wires through the coil.

Some caps for twist on connectors used in the electrical industry today, may be made of thermosetting resin. Such types of material have a low modulus of elasticity and thus are not easily elastically deformable, together with a high resistance to plastic deformation—desirable characteristics of wire connectors. However, more recently it has become desirable to use thermoplastics, such as nylon, as the material used in the manufacture of connector caps for a variety of reasons, such as cost consideration in the production process and colour choice. Thermoplastics, however, are relatively elastic and therefore are easily deformed when tightened onto a pair of wires, generally tending to bulge around the periphery. It is possible to make such caps using an injection moulding process, but a cap configuration not specifically designed to be injection molded may provide problems for such manufacture, primarily due to cooling considerations.

Many presently available thermoplastic caps are thick walled with either small raised lines for gripping purposes, or thick walled with a plurality of thick ribs for gripping and twisting purposes. Most thin walled thermoplastic caps that are available employ an internal expansion coil which applies most of the retaining force used to bind the plurality of wires together. Such coils only contact the plastic connector cap at the ends of the coil and therefore transmit only a small fraction of the bursting forces to the cap. As a result, the cap does not need to be of high strength since the expansion coil bears the stresses involved. Thus the expansion coil needs to be of high quality, and therefore higher cost, than if it did not need to absorb the bursting forces.

DESCRIPTION OF THE PRIOR ART

U.S. Pat. No. 4,150,251 issued April 17, 1979, to SCOTT discloses a twist-on wire connector having a thin walled insulatingcap that may be made from one of a variety of plastic insulating materials, including thermoplastic materials. This type of cap, however, requires a sheet metal retainer or cup to be used in conjunction with it. The bursting forces exerted by the wires being compressed when they are connected, are absorbed by the plastic deformation of the sheet metal retainer. These forces are not transmitted to the insulating cap, thus the cap does not need to be of substantial strength.

U.S. Pat. No. 4,112,251 issued September 5, 1978, to SCOTT discloses a twist-on wire connector made of a thermoplastic material, and having an expansion coil. The bursting forces exerted by the wires are absorbed by the elastic deformation of the coil. Such expansion does not place bursting forces on the cap since the coil and the cap contact only at the ends of the coil.

Canadian Pat. No. 1,033,432 issued June 29, 1978 to NORDEN discloses a screw-on electrical connector made of a deformable insulating material suitable for injection moulding from a wide variety of plastic. The coil inside the connector is a non-expansion spring however, and the cap is not relatively thin walled.

These previous thermoplastic material caps for use with expansion coils are necessarily very specific in their sizes, and hence are quite restricted in the number and combination of wires and wire sizes which they may be used to connect.

Canadian patent application No. 540,005 copending herewith and assigned to the same assignee, describes and claims a relatively thin walled thermoplastic material cap having external ribs for rigidity and having a coil substantially in intimate contact with the cap wall. Such a cap is useful with non-expansion coils.

SUMMARY OF THE INVENTION

In order to produce the caps in an economical manner, it is desirable to have them cool as quickly as possible in the injection mould. For this to occur, there must be no large masses of plastic within the cap. It is therefore desirable to design the cap such that it has a relatively thin circumferential wall and that any associated integral portions thereof, such as those used for gripping or guiding the wire into the connector, are also relatively thin. Such a cap is made possible by the invention described and claimed in U.S. Pat. No. 4,924,035 issued May 8, 1990.However, in that invention, the coil must be in substantially intimate contact along its entire length with the inside of the cap, in order to provide a means for good transmission of forces. It is therefore desirable to design a cap moldable in thermoplastics material, which will cool relatively quickly in the mould, and which has fins to aid heat dissipation and permit good grip by the fingers for turning, or which is capable of providing engagement means for twisting by means of an overcap or collar.

Such an over-cap or collar in combination with a connector cap is described and claimed in U.S. Pat. application Ser. No. 242,531 filed on Sept. 12, 1988, now abandoned, and assigned to the same assignee as this application.

It is further desirable that a twist-on connector cap have a sufficient degree of rigidity to accommodate an expansion coil suitable for use over a wide range of wire sizes and number of wires to be connected, thus reducing the larger number of differently sized connector coils and moulded caps which have previously been necessary. The cap should preferably also be so designed to be relatively thin-walled.

Accordingly, the invention provides a twist-on insulating connector comprising an expansion coil spring;

an insulating cap substantially shaped as a frustum having a small closed end and a larger open end leading to an axial bore within a peripheral wall between the ends;

the bore including a wire receiving portion adjacent to the end and leading to a wire guiding portion, narrowing to a wire retaining portion containing said spring;

the spring being adjacent the wire retaining portion only at the ends thereof and being spaced inwardly therefrom over at least a major portion of its length;

the cap including a plurality of longitudinal strengthening fins extending radially therefrom at least over the length of the wire retaining portion.

The wire receiving portion may be such that the spring is constrained thereby, before damage occurs to it through expansion.

BRIEF DESCRIPTION OF THE DRAWINGS

A typical embodiment of the invention will now be described by way of example, with reference to the drawings in which.

DETAILED DESCRIPTION OF THE PREFERRED EMBODIMENTS

Figure 1:
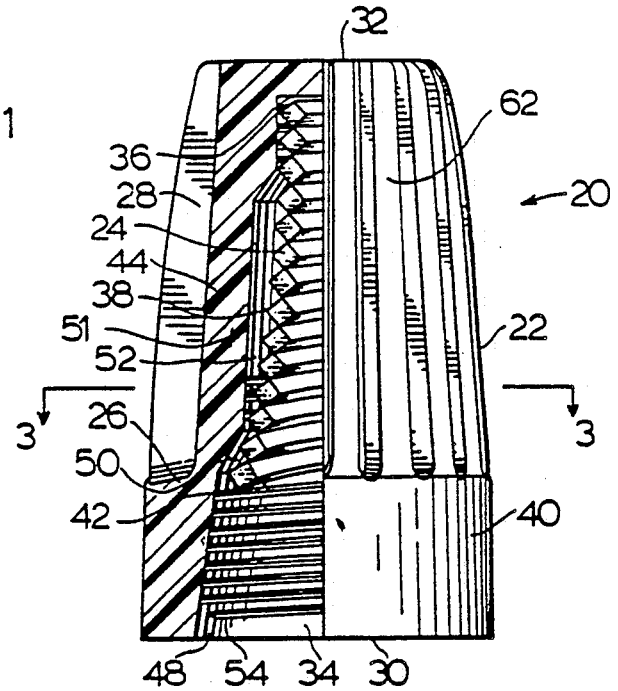
FIG. 1 is a view, partially in section, of a cap containing an expansion spring connector.
Figure 2:
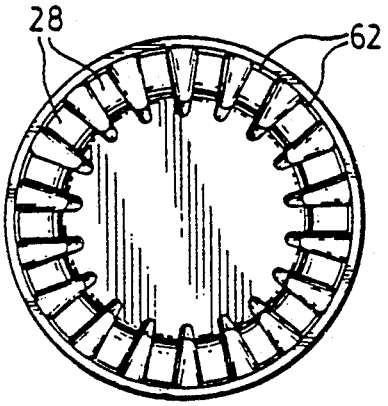
FIG. 2 is a top view of the cap.
Figure 3:
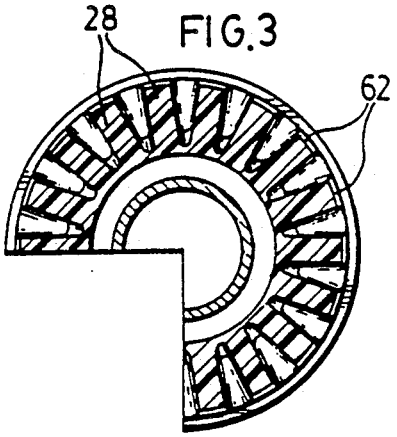
FIG. 3 is a partly cut away section on line 3—3 of FIG. 1.

A twist-on connector 20 comprises a thermoplastics material insulating cap 22 and a wire expansion coil 24 contained therein. The connector 20 is adapted to receive the ends of a plurality of wires to be connected electrically. A square wire coil, as shown, may be preferable because the edge of the coil is adapted to cut into the wires, but any conventional expansion coil may be used. The thermoplastics material may suitably be a polymeric material such as a nylon, polypropylene, or polyethylene or a copolymer thereof.

The cap 22 includes a cap body 2 plurality of fins 28. The cap 22 has a larger open end 30 to receive wires, and a smaller closed end 32 to preclude the passage of any wires contained in the interior 38 of wire connector 20 and to provide insulation for the wires within the cap. The cap body 26 is generally hollow, having an exterior surface 40 and an interior surface 42, and includes a peripheral wall 44 and the closed end 32. The wall 44, is disposed between the ends 30, 32. For example, in a cap having a length of approximately 1.1 inches, and a diameter of approximately 0.0655 inches at the open end 30, the wall thickness nearest the end 30 may be in the order of 0.055 inches, with the wall portion near the end 32 being somewhat thicker.

The interior surface 42 defining a bore in the cap 22 is divided into three portions: a wire receiving portion 48, a guide portion 50, and a wire retaining portion 52. These three portions are all substantially co-axially aligned, seriatim, within the cap body 26.

The wire receiving portion 48 is tapered slightly inwardly to receive a plurality of wires, and includes threads 54 to help catch any relatively soft insulation of any wires entering the connector. This can aid in drawing the wires into the interior 38 of the connector 20 as they are twisted relative to one another. Additionally, the wires may be retained better in the connector 20 once they are in place, if portions of the thread 54 have cut into any insulation of the wires.

The wire receiving portion 48 leads to the guide 50 which is sloped more sharply as a guide for wire ends, leading them to expansion coil 24 in the wire retaining portion 52.

The manner in which a plurality of wires is inserted into connector 20 and subsequently connected, will now be described.

The connector cap is placed over the ends of the wires to be connected, until the wires and the coil 24 contact one another. The connector cap, which is grasped between the thumb and fingers, is turned in the appropriate direction—clockwise when viewed from the distal end of the connector. When the connector cap is turned, the group of wires is tapped according to the helix of the coil 24 in the expansion chamber, and they advance into the connector. The coil expands into space 51 of the cap and tends to absorb bursting forces, and the coil may ultimately contact the wall of the cap 22 within the expansion chamber 51 to prevent further expansion. This may allow for the use of expansion coils of lesser quality than has heretofore been possible, since excessive forces on the coil may be limited by the cap.

The expansion coil 24 may be made, when undeformed, to be slightly narrower adjacent its mid point of length so that it may be of "waisted" shape. This allows better initial grip on the wires and optimizes use of expansion chamber 51. This is because unlike conventional connector caps, cap 22 does not deform with the coil 24 but the plurality of fins 28 acts to preserve rigidity. It has been found that from about 14 to about 18 fins is an optimal number.

The combination of features including the waisted shape of the spring, the expansion space within the cap, and the rigid walls containing the bursting forces may make it possible to use a single connector according to the invention with a greater number of wires of different thicknesses than has heretofore been possible. At least partially, the reason for this is that the connectors according to the invention may be less critical in performance due to the inventive features.

The radially extending fins 28 are moulded as an integral part of the cap; and are generally at right angles to the wall 44. The fins 28 extend longitudinally from the end 32 substantially along the entire length of the wall 44 to the area corresponding to the wire guide portion 50 on the interior surface 42. The fins 28 are preferably spaced substantially equally around the wall 44, with the distance between any two adjacent ribs being the two-point threshold for a typical human finger, which is usually in the order of three to six millimeters. This means that the pressure transmitted to the fingers and thumb is distributed fairly evenly thereto, and there are no small local areas of high force due to a small part of the cap digging into the fingers or thumb. This results in a more comfortable grip for the user. Alternatively, an over-cap or collar as described and claimed in U.S. Pat. application Ser No. 242,531 filed on Sept. 12, 1988 now abandoned may be used. Each fin 28 may have substantially flat parallel side walls joining an outer wall through substantially 90 degree corners. Thus very good grip on the cap is possible.

Proper electrical connection requires a tight physical connection between the wires being connected and between the wires being connected and the conductive coil part of the connector. It is very important that these connections be tight enough that gaps cannot develop between the contacting surfaces. If a gap develops, there may be a possibility that the surfaces at these points will oxidize, and result in . connections that are relatively high in resistance. Such high relative resistance connections may produce a great amount of heat while conducting electricity, due to the fact that the power dissipated by the connection is proportional to the resistance and to the square of the current.

Figure 4:
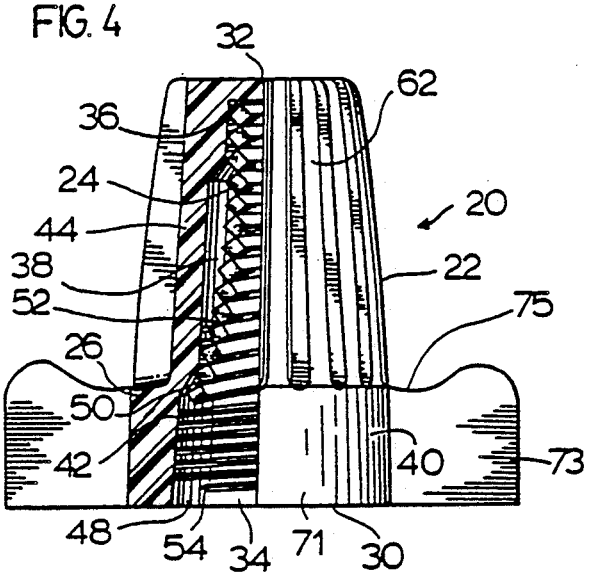
FIG. 4 is a view similar to FIG. 1 of a cap having additional wings.

FIG. 4 shows another embodiment in which the exterior of the cap 22 in the region of the wire receiving portion is in the form of a smooth band 71 and is provided with a pair of diametrically opposed wings 73. The roots 75 of the wings 73 may extend over the height of the band 71 and spread into wings 73, which may be shaped for conventional manual manipulation.

The thickness of wings 73 should be sufficient that they are not unduly flexible under finger pressure, and so that they are capable of acting as levers through which additional torque may be transmitted to cap 22.

When the wires are inserted into the connector and the connector is turned so as to threadibly engage the wires, the edges of a square wire coil will cut into the wires slightly, thus precluding the wires from slipping out of the connector. However, expansion coils of round wire may also be used. As the connector cap is turned, the wires and the connector are drawn inwardly towards one another such that the ends of the wires move towards the closed end of the connector. As the connector is tightened onto the wires, the wires become pressed tightly together and exert reaction forces, generally referred to as bursting forces. These bursting forces cause the coil to expand and also to shorten.

The present invention provides a structure which may satisfy the requirements for good moulding techniques, permitting production of the moulded thermoplastic caps in an economical manner, as noted above. The use of generally thin walled sections, not only in the circumferential wall of the cap but also in respect of the ribs extending radially outwardly therefrom, assures relatively even cooling with a short cooling cycle of the moulded part within the mould. This, in turn, precludes moulding deficiency such as sink marks, which could materially affect the electrical and mechanical properties of the cap, as well as make the product less visually acceptable.

We claim:

1. A twist-on insulating connector comprising an expansion coil spring;

an insulating cap substantially shaped as a frustum body, having a small closed end and a larger open end leading to an axial bore within a peripheral wall between the ends;

the bore including a wire receiving portion adjacent the open end and leading to a wire guiding portion, narrowing to a wire retaining portion containing said spring;

the spring being adjacent the wire retaining portion only at the ends thereof and being spaced inwardly therefrom over at least a major part of its length;

the cap having a circumferential wall portion including a plurality of longitudinal strengthening fins extending radially therefrom at least over the length of the wire retaining portion;

wherein said longitudinal strengthening fins are circumferentially evenly spaced and radially outwardly extending from at least said wire retaining portion of said cap;

wherein said fins are generally straight and parallel and of substantially constant thickness, so as to provide structural reinforcement to said circumferential wall portion;

wherein the distance between two adjacent ones of said fins is below the 2-point threshold of discrimination for a human finger; and wherein said circumferential wall portion is generally thin.

2. The twist-on insulating connector of claim 1, wherein said cap is made of a thermoplastic material.

3. The twist-on insulating connector of claim 2, wherein said thermoplastic material is a polymeric material chosen from the group consisting of nylon, polypropylene, polyethylene, and a copolymer of polypropylene and polyethylene.

4. The twist-on insulating connector of claim 1, wherein at least one pair of diametrically opposed levers projects outwardly from the cap whereby additional torque is manually applicable to the cap.

* * * * *